United States Patent [19]

van den Berg

[11] 4,393,270

[45] Jul. 12, 1983

[54] CONTROLLING PERCEIVED SOUND SOURCE DIRECTION

[76] Inventor: Johannes C. M. van den Berg, Kleibroek 14, Castricum, Netherlands

[21] Appl. No.: 153,903

[22] Filed: May 28, 1980

Related U.S. Application Data

[63] Continuation-in-part of Ser. No. 964,372, Nov. 28, 1978.

[30] Foreign Application Priority Data

Nov. 28, 1977 [NL] Netherlands ..... 7713076

[51] Int. Cl.[3] ..... H04R 3/00; H04R 5/00

[52] U.S. Cl. ..... 179/1 D; 179/1 GP

[58] Field of Search ..... 179/1 D, 1 G, 1 GP

[56] References Cited

U.S. PATENT DOCUMENTS

| | | | |
|---|---|---|---|
| 3,784,745 | 1/1974 | Stearns | 179/1 N |
| 3,970,787 | 7/1976 | Searle | 179/1 AT |
| 4,219,696 | 8/1980 | Kogure et al. | 179/1 G |

*Primary Examiner*—George G. Stellar

*Attorney, Agent, or Firm*—Daley, Boettcher & Brandt

[57] ABSTRACT

An electronic signal representative of a sound is processed by applying different amplitude adjustments to the different components of the signal, these amplitude adjustments vary with frequency in a manner corresponding to the variation with frequency of the auditory response of a normal human listener for sounds impinging on him from a preselected direction of perception. When the electronic signal is converted into sound, the relationship of the amplitudes of the various components of the signal causes the listener to believe that the sound is impinging on him from the preselected direction.

6 Claims, 16 Drawing Figures

CONTROLLING PERCEIVED SOUND SOURCE DIRECTION

RELATED APPLICATION DATA

This application is a continuation-in-part of U.S. Patent Application Ser. No. 964,372, filed Nov. 28, 1978.

BACKGROUND OF THE INVENTION

The invention relates to a method of processing an electronic signal representative of a sound for direct reproduction or for recording. The invention further relates to an apparatus for processing an electrical signal repesentative of a sound for direct reproduction or for recording.

Direct reproduction of picked-up sound is employed, for example, in live radio broadcasts in which sound is picked up and directly transmitted. Recording of picked-up sound is effected, for example, on grammophone records or audio tapes. A problem inherent in presently known sound recording techniques is that the sound cannot be recorded so that the listener obtains an optimal spatial impression of the recorded sound when it is reproduced. In so-called stereophonic systems employing at least two separate microphones or microphone systems for sound recording and at least two separate channels for sound reproduction, a certain spatial impression is created indeed. This spatial impression is even better when using the recording technique described in U.S. Pat. No. 4,074,084, in which for recording sound at least two microphone systems of the dummy head type are used, signals from corresponding microphones of the dummy heads being coupled with each other and, when reproducing the recorded sound, being reproduced in one of the two channels. Although in this manner a considerable enhancement of the sound reproduction is achieved, it remains difficult and even impossible to realize such a sound reproduction that the listener is able to at all times distinguish directions in the sound, such as in front and behind, above and below, left and right.

It is an object of the invention to provide a solution to the above problem and to provide a method and apparatus for sound recording or for processing recorded sound prior to its reproduction so that a truly directional sensation is experienced during the reproduction.

It has long been known that the variation of amplitude pressure response of the normal human auditory system versus frequency is different for different angles of incidence of sound on the listener. These differences are apparent in the curves of sound pressure response of the ear canal versus frequency for different angles of incidence depicted in FIG. 6. These curves are taken from the article appearing in the publication Funkschau, 1974 Heft 11, pages 399–402. For example, the topmost one of these curves, denominated "$\theta=0$", shows that for sound impinging on the listener from directly in front of him, the sound pressure response of the ear canal is relatively flat from about 4000 hertz to about 7000 hertz, with the response at 4000 through about 7000 hertz being about 9 decibels lower than the response at about 2200 hertz. When sound of equal sound pressure for all frequencies impinges on the listener from directly in front of him, the sound pressure produced in the ear canel by the 2200 hertz component will be greater than the sound pressure produced by the 4000 and 7000 hertz components and the sound pressures produced by each of these latter components will be approximately equal. By contrast, the next curve (denominated "$\theta=45°$") shows that the sound pressure response curve is markedly different for sounds impinging on the listener from an angle of about 45°. If sound of equal sound pressure at all frequencies impinges on a listener at an angle of about 45°, the component at about 2300 hertz will produce the greatest sound pressure in the ear canal. The component at about 4000 hertz will produce a sound pressure about 9 decibels less than that produced by the component at about 2300 hertz. The component at about 7000 hertz will produce a sound pressure almost equal to that produced by the component at 2300 hertz and about 8 decibels greater than that produced by the component at about 4000 hertz.

The present invention results from the realization that a human being can use the differences in amplitude response as cues for determining where a source of sound is located. For example, if a person is directly facing a piano so that the sound of the piano is impinging upon him from directly in front of him, and the piano simultaneously produces notes of equal amplitude at 2200 hertz, at 4000 hertz and 7000 hertz, the sound pressure level in the listener's ear produced by the 2200 hertz note will be greater than that produced by the 4000 hertz note or the 7000 hertz note, and the sound pressure levels produced by the 4000 hertz note and 7000 hertz note will be approximately equal to one another. The listener does not regard this sound as distorted; he perceives all of these notes as being of equal amplitude. If the piano then moves to a location 45° to the left of the listener, and repeats this same set of notes, the sound pressure levels produced in the listener's ear canal will be different. The notes at 2200 and 7000 hertz will produce almost equal levels of sound pressure, while the note at 4000 hertz will produce a level of sound pressure distinctly lower than either of the other two notes. The listener, however, still does not regard the sound as distorted, even though the relative sound pressure levels produced by the three notes of the set have changed markedly. Rather, the listener still recognizes all of the notes as being of equal amplitude but now believes that they emanate from a source at 45° to him. In short, the listener is cued by the difference in distortion to recognize a difference in direction.

The present invention results from the further realization that, if an electronic signal representative of a sound is processed to introduce into it amplitude distortions corresponding to the distortions introduced by the human auditory system for sounds impinging on the listener from a preselected direction, and the electronic signal is then converted into sound, the response of the listener's auditory system will vary according to frequency as though the sound were impinging upon the listener from the preselected direction. The listener will believe that the sound does impinge upon him from such preselected direction even if it is, in fact, impinging on him from some other direction. The listener will be unable to tell whether the differences in the amplitudes of the responses were induced by the natural distortion caused by his anatomy or by artificial distortion introduced electronically.

Thus, in the method of the present invention, directional information is added to an audio frequency electronic signal including components of various frequencies by differentially adjusting the amplitudes of the various components.

In the method of the present invention, an electronic signal representative of a sound is processed, prior to its reconversion into sound. In such processing, the signal is modulated with a "modulating signal" representative of a specific, preselected direction of perception, so that when the electronic signal is subsequently reconverted into sound, the sound will be perceived as seemingly emanating from a source disposed in such preselected direction from the listener.

As used herein, the verb "modulate" should be understood as meaning "to impress information on a signal". Also, the term "signal" should be understood as meaning "information or intelligence". Thus, in the method of the present invention, various amplitude adjustments are applied to various components of the electronic signal. These amplitude adjustments vary with frequency in a manner corresponding to the variation of amplitude response with frequency of the normal auditory system for sounds impinging on the listener from a preselected direction of perception. Thus, the pattern of amplitude adjustments constitutes the intelligence or modulating signal which is impressed upon the original electronic signal.

The method of the present invention may be applied to an electronic signal representative of a sound signal either in a sound reproduction method wherein the electronic signal is reconverted into sound substantially simultaneously with its formation, or in a method of sound reproduction in which the electronic signal is recorded. For example, the method of the present invention may be applied in live radio broadcasting to process an electronic signal which is substantially simultaneously broadcast, received by a radio receiver, and reproduced into sound, and the method of the present invention may be applied to process an electronic signal which is recorded and then reproduced into sound at some later time. The method of the present invention may be applied to process a single electronic signal by modulating it with a modulating signal representative of a single preselected direction of perception, and the method of the present invention may also be applied to simultaneously process a plurality of electronic signals by modulating each of such signals with a different modulating signal representative of a different preselected direction of perception.

The plural signal processing methods of the present invention preferably include the step of creating the electronic signals to be processed by use of a plurality of directional microphones, each adapted to receive sound predominantly from a specific preselected reception direction. The electronic signal created by each such microphone is separately processed to modulate it with a modulating signal characteristic of a preselected direction of perception corresponding to the reception direction of such microphone. When a plurality of microphones is used these microphones are preferably mounted relative to each other so that they are located on an imaginary or real spherical surface, and so that the reception direction of each microphone corresponds with its location on the spherical surface.

The present invention also includes apparatus for modulating an electronic signal with the manner described above. Such apparatus includes a "direction characteristic forming unit" which is capable of modulating an electrical signal with a modulating signal representative of a preselected direction of perception, to thereby apply varying amplitude adjustments to different portions of such electrical signal.

The present invention also includes a method of determining the variation in response with frequency of the human auditory system for sounds impinging on the listener from any direction. This method of measurement can be utilized to compile more accurate data to supplement and correct the previously known data.

By employing a direction characteristic forming or introducing element or elements, in accordance with the invention all the desired corrections with respect to phenomena affecting the direction of perception can be applied to an electronic signal representative of a sound prior to reconversion of such signal into sound. Additional correction (modulation of the electronic signal with a further modulating signal) may be useful if the signal is to be reproduced into sound through loudspeaker boxes. When reproducing through loudspeaker boxes, the position of these boxes relative to the listener will introduce a further, undesired direction characteristic into the sound. This can be compensated for in advance by further modulating the signal to be reproduced so that such undesired direction characteristic is nullified. Thus, if the electrical signal is to be reproduced into sound by a loudspeaker disposed in a loudspeaker direction from the listener, the signal should be additionally modulated with a signal comprising a pattern of amplitude adjustments which is the inverse of the direction characteristic of such loudspeaker direction. If desired, for this purpose the reproducing means themselves (in this case the loudspeaker boxes) may include an element providing the desired inverse characteristic.

The method according to the invention may be combined to advantage with the method described in the above U.S. patent. In that case, a method of recording sound is achieved in which the sound is picked up by means of at least two microphone systems each, in accordance with the invention, coupled in one way or another with direction characteristic forming elements, the signals originating from each microphone of a system being coupled, prior to or after their modulation, with the signals originating from the corresponding microphone or microphones of the other system or the other systems.

The invention will now be described in greater detail with reference to the accompanying drawings, in which:

FIG. 1 schematically shows the arrangement of a possible embodiment of the apparatus according to the invention;

FIG. 2 schematically shows the arrangement of another embodiment of the apparatus according to the invention;

DETAILED DESCRIPTION OF THE PREFERRED EMBODIMENTS

Figure 1:
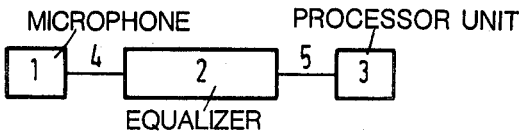

FIG. 1 schematically shows an embodiment of the apparatus according to the invention. The basic components of this apparatus are a microphone 1 (or a terminal plug for a microphone) and a direction characteristic forming element 2. The sound signal received by the microphone 1, which may but need not be a directional microphone, is applied through line 4 to the direction characteristic forming element 2. This element is preferably a device known as an "equalizer" in the sound recording technique art.

As used herein the term "equalizer" should be understood as meaning "a device for applying different amplitude adjustments to different components of an electrical signal, such amplitude adjustments varying with the frequencies of the various components of the electrical signal in a desired manner". One appropriate form of equalizer for use in the present invention is sold under the designation "Altec Lansing 729A Acousta-Voicette Stereo Equalizer" by the firm of Altec Lansing, Anaheim, Calif. This unit comprises two sets of 24 filters each; each set of filters is separate connected to process a separately signal. Each set of filters includes 24 separately adjustable filters, each such filter being active in a different frequency band. The frequency bands of the separate filters overlap one another so that they cooperatively encompass the entire range of frequencies from 63 to 12,500 hertz. A separate front panel control is provided for adjusting the attenuation introduced by each such filter.

Either one of the two sets of filters provided in the "Acousta-Voicette" equalizer can be used as a "direction characteristic forming unit" for impressing a pattern of relative amplitude adjustments on a single electronic signal in the present invention. To do this, the filters of such set are adjusted so that the set of filters will cooperatively apply a pattern of amplitude adjustments corresponding to the desired pattern, such as for example a pattern of amplitude adjustments corresponding to one of the response curves depicted in FIG. 6. The actual pattern of amplitude adjustments impressed upon the signal may be checked by using a signal generator to apply a "white" signal having components of equal amplitude at all frequencies to the direction characteristic forming unit while using a real-time frequency spectrum analyzer automatically draw a graph of the output amplitude versus frequency. Any deviation of the actual system response from the desired system response can be detected by comparing the graph drawn by the freqquency spectrum analyzer with the desired response curve and the filters of the equalizer can be further adjusted to compensate for such deviations.

Element 2 modulates the electrical signal applied thereto with the desired modulating signal or direction characteristic, i.e. a pattern of amplitude adjustments which varies with frequency in a manner that is characteristic of the respective direction. The thus-modulated signal is applied through line 5 to the processor unit 3. This unit may be a recorder for recording the sound on an audio tape or may be a component of a transmitted installation for directly transmitting the received sound. It will be clear that line 4 is not necessary if, by using integrated circuit techniques, the dimensions of the direction characteristic forming element 2 are made sufficiently small to allow this element to be combined with microphone 1 into a single, integral unit.

Figure 6:
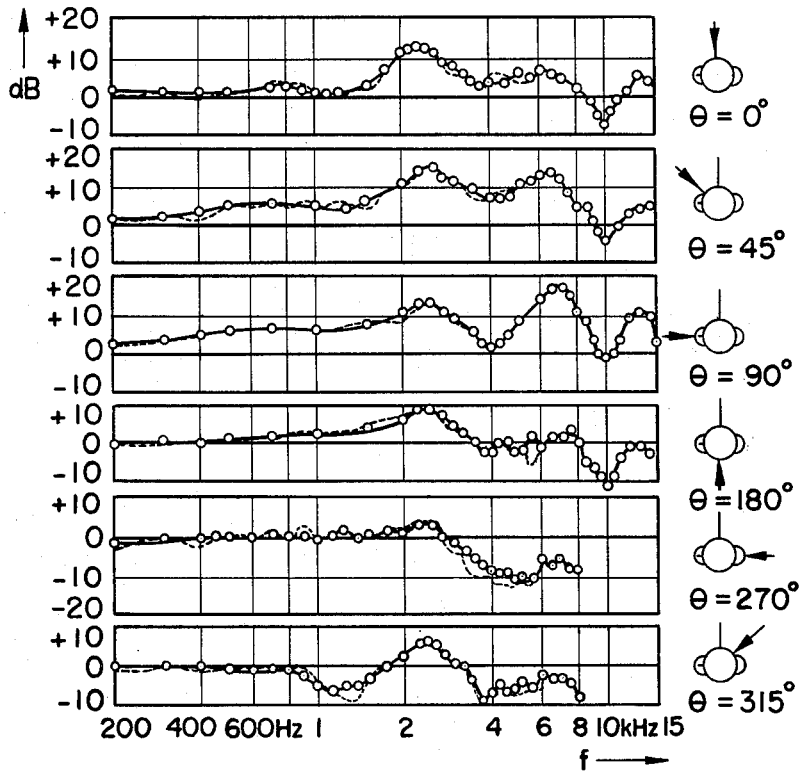
FIG. 6 is a graph showing sound pressure variations at the entrance of the cavity of the ear of an average listener for several different angles of incident sound, as described previously herein.

As stated above, the direction characteristic forming unit 2 applies a modulating signal representative of a preselected direction of perception. Thus, when the electronic signal is ultimately reconverted into sound and the sound is heard by the listener, the listener will believe that the sound is emanating from a source disposed in such preselected direction from him. For example, the microphone 1 may pick up sounds from a musical instrument. If the direction characteristic forming unit or equalizer 2 is adjusted to apply a modulating signal for pattern of amplitude adjustments corresponding to the normal human auditory response curve for sounds impinging on a listener from directly in front of him, then, when the electronic signal is reconverted into sound and the sound is heard by the listener, the listener will believe that the sound is emanating from a source disposed directly in front of him. For this purpose, the direction characteristic forming unit or equalizer should be adjusted to apply a pattern of amplitude adjustments corresponding to the response curve depicted in the topmost one of the graphs shown in FIG. 6. Thus, for example, greater attenuations should be applied to the components of the electronic signal having frequencies from about 200 hertz to about 1500 hertz than to the components of the electronic signal having frequencies of about 2300 hertz. The components of the signal having frequencies from about 4000 hertz to about 7000 hertz should be attenuated to approximately equal degrees, and such attenuations should be less than those applied to the components from about 200 hertz to about 1500 hertz but greater than any applied to the components at about 2300 hertz. In effect, the 2300 hertz component will be boosted to a greater degree than the 4000 to 7500 hertz components, and these components in turn will be boosted to a greater degree than the 200 to 1500 hertz components. Of course, the curves in FIG. 6 are continuous curves, covering the entire audio frequency spectrum; appropriate amplitude adjustments must be applied by the direction characteristic forming unit or equalizer at all audio frequencies to properly match any such curves.

Figure 7:
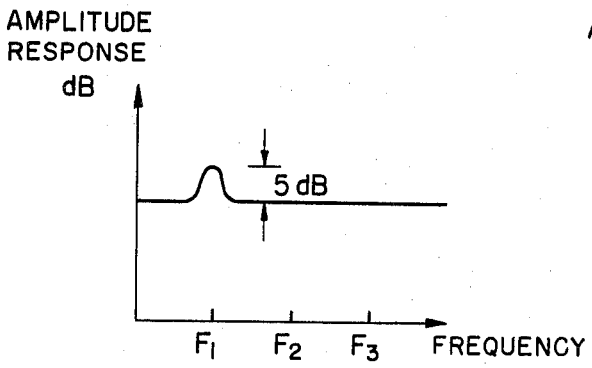
FIG. 7 is a schemtic version of an auditory system response curve, simplified for purposes of clarity of illustration.
Figure 8:
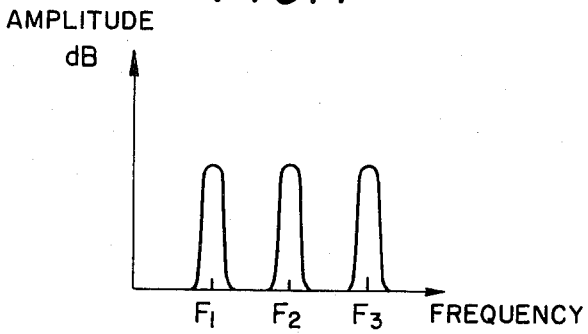
FIG. 8 is a schematic representation of an arbitrary sound on an amplitude versus frequency diagram.
Figure 9:
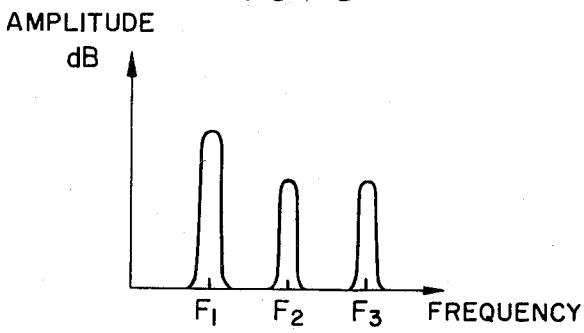
FIG. 9 is a representation of the same arbitrary sound as shown in FIG. 8 showing such sound after it has been altered in accordance with the response curve depicted in FIG. 7.
Figure 10:
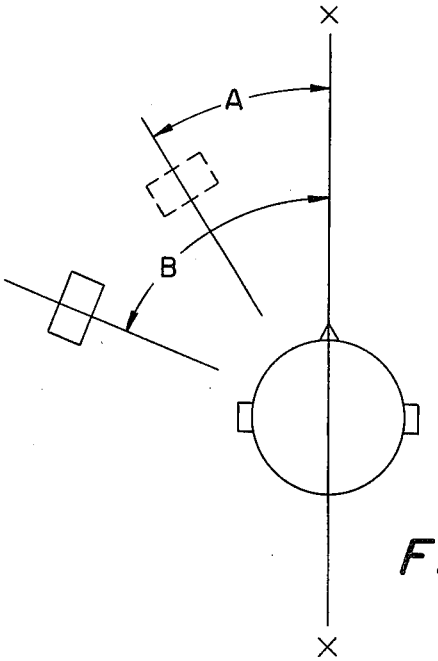
FIG. 10 is a schematic depiction of a loudspeaker disposed in an arbitrary loudspeaker direction from the listener.

The principles of the present invention, and the operation of the direction characteristic forming unit may be further understood with reference to a fictional example in which the response curves and patterns of amplitude adjustments have been greatly simplified for purposes of illustration. As seen in FIG. 10, it may be desired to modulate the electronic signal so that when such signal is reproduced into sound and the sound is heard by a normal human listener, the listener will believe that such sound is impinging upon him from a source disposed in an arbitrary direction A from him. That is, the listener will believe that the sound is emanating from a source disposed at an arbitrary angle A to the anterior-posterior axis X of his head. For the purposes of the example, it is to be assumed that the normal human auditory system has a response curve as seen in FIG. 7 for sounds impinging on the listener form the direction A. This response curve is entirely flat, except for a peak, 5 decibels higher than the remainder of the curve, at a frequency $F_1$. Thus, if the listener heard the three note sound schematically depicted in FIG. 8, consisting of signals of equal amplitude at frequencies $F_1$, $F_2$, $F_3$, and such sound impinged on the listener from a source located in direction A from the listener, then the listener's auditory system would boost the note at $F_1$ by 5 db relative to the notes at $F_2$ and $F_3$. Thus, the relative amplitudes of the notes would be as depicted in FIG. 9, the amplitude of the note at $F_1$, would be 5 db greater than the amplitudes of the notes at $F_2$ and $F_3$. However, the listener would not regard this sound as being distorted. Rather, the listener would be cued by the difference in amplitudes of the various components of the sounds as processed by his auditory system to recognize the sounds as emanating from a source disposed in direction A from him.

In the present invention, the differentials in amplitude described above are produced electronically. In this example, the equalizer or direction characteristic forming unit would be set to apply a pattern of amplitude adjustment to the various components of the electronic signal corresponding to the curve of FIG. 7. Thus, the direction characteristic forming unit would be set to apply 5 db less attenuation (or 5 db more boost) to the component of the electronic signal at frequency $F_1$ than to the components at other frequencies, such as $F_2$ and $F_3$. Assuming that a sound of the pattern shown in FIG. 8 (with equal amplitude components at $F_1$ $F_2$, $F_3$) is converted by a good microphone into an electronic signal, the electronic signal will also have the pattern shown at FIG. 8; the components of the electronic signal at $F_1$, $F_2$, and $F_3$, will be of equal amplitudes. After this signal is modulated by the direction characteristic forming unit, the electronic signal will be of the pattern shown in FIG. 9. The amplitude of the component at frequency $F_1$ will be about 5 db greater than the amplitudes of the components at $F_2$ and $F_3$. If this electronic signal is then reconverted into a sound and processed by the auditory system of the listener without further distortion, the auditory signal will also be as shown in FIG. 9. That is, the auditory signal will be exactly the same as that which would be produced if the sound impinged on the listener from a source disposed in the direction A (FIG. 10) from the listener.

Figure 11:
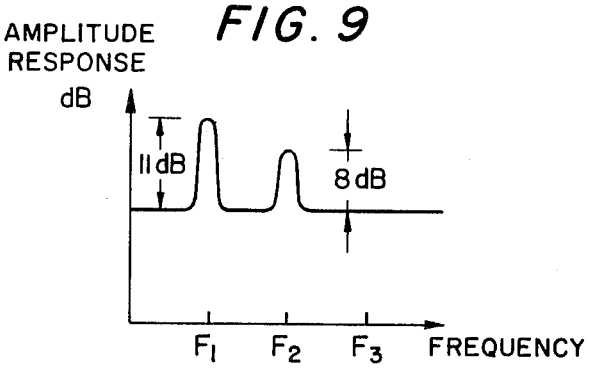
FIG. 11 is a schematic diagram of an auditory system response curve representative of the loudspeaker direction shown in FIG. 10, simplified for purposes of clarity of illustration.

If the electronic signal is to be converted into sound by an ordinary loudspeaker and then transmitted through the air to the listener, the sound will suffer further distortion as it is processed by the listener's auditory system. To continue with the example, assume that the electrical signal is to be converted into sound by a loudspeaker disposed in a loudspeaker direction B from the listener. Assume further that the normal human auditory system has a response curve such as that shown in FIG. 11 for sounds impinging on the listener from direction B. This simplified hypothetical response curve is entirely flat except for a boost of about 11 db at frequency $F_1$ and a boost of about 8 db at frequency $F_2$. If the electronic signal described above in this example is reproduced by a loudspeaker disposed in the loudspeaker direction B from the listener, the response curve depicted in FIG. 11 representative of the loudspeaker direction, will be superimposed on the sound as the sound is heard by the listener. Thus, the component of the sound at frequency $F_1$, which is already 5 db greater in amplitude than the components at $F_2$ and $F_3$ will be further boosted by 11 db and the component at $F_2$ will be boosted by 8 db. This would result in an unrealistic pattern within the listener's inner ear. In total, the component of the sound at $F_1$ would be 16 db greater in amplitude than the component at F3, and the sound at $F_2$ would be 8 db greater than the component at $F_3$.

Figure 12:
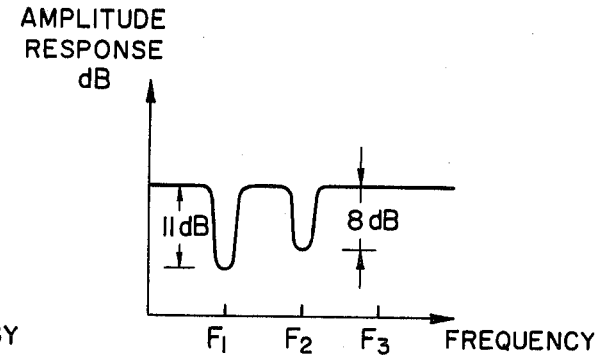
FIG. 12 is a schematic diagram of a modulating signal or pattern of amplitude adjustments inverse to the response curve depicted in FIG. 11.
Figure 13:
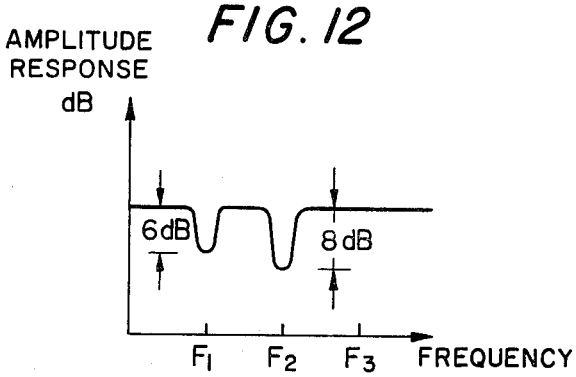
FIG. 13 is a schematic diagram of a curve representing the addition of the curves shown in FIGS. 7 and 12.

To counteract this undesirable effect, the electronic signal can be further modulated before it is reconverted into sound by the loudspeaker. In this additional modulation step, a modulating signal or pattern of amplitude adjustments corresponding to the curve shown in FIG. 12 would be applied to the signal. This curve is exactly the inverse of the human auditory response curve for the loudspeaker direction seen in FIG. 11. Thus, the pattern of amplitude adjustments or additional modulating signal depicted in FIG. 12 is entirely flat except for 11 db attenuation at $F_1$ and an 8 db attenuation at $F_2$. The combined effect of the inital modulation of the electronic signal according to the curve of FIG. 7 described above, and the additional modulation according to the curve of FIG. 12 is shown in FIG. 13. The electronic signal is attenuated 6 db at $F_1$ and 8 db at $F_2$. When this signal is then reconverted into sound by the loudspeaker disposed in direction B as in FIG. 10, and the sound is then heard by the listener, the various frequency components of the sound will be distorted naturally by the listener's auditory system according to the pattern shown in FIG. 11. The $F_1$ component will be boosted by 11 db and the $F_2$ will be boosted by 8 db. Thus, as finally processed by the listener's auditory system, the $F_1$ component will have an amplitude approximately 5 db greater than the $F_3$ component, and the $F_2$ component will have an amplitude approximately equal to the $F_3$ component. Thus, the second actually perceived will have exactly the same pattern of amplitudes as would be produced by sounds impinging on the listener from a source disposed in direction A from the listener.

The two modulating steps can be performed in two separate direction characteristic forming units or equalizers, but they can also be performed in a single direction characteristic forming unit or equalizer. In such a combined modulation step, the modulating signal or pattern of amplitude adjustments representative of the desired preselected direction of perception would be added to the modulating signal or pattern of amplitude adjustments which is the inverse of the pattern representative of the loudspeaker direction, and this combined modulating signal would be applied to the electronic signal. To refer back to the example, the modulating signal or pattern of amplitude adjustments corresponding to that shown in FIG. 7 would be added to the inverse modulating signal or pattern of amplitude adjustments shown in FIG. 12 to produce the combined modulating signal or pattern of amplitude adjustments shown in FIG. 13, and this combined modulating signal would then be applied to the electronic signal before reproduction of such signal into sound.

It is advantageous to perform the two modulating steps separately if the manner in which the electronic signal will be reproduced into sound is unknown to the persons performing the initial modulation step. For example, a broadcasting or recording engineer may know that the electronic signal which he is processing is intended to represent a sound coming from 30° to the left of the listener. Thus, he knows the "preselected direction of perception" and he adjusts his direction characteristic forming unit to introduce a modulating signal representative of such preselected direction of perception. However, the broadcasting or recording engineer does not know whether the electronic signal will ultimately be reproduced through a loudspeaker disposed in front of the listener, in back of him, or to one side of him. Therefore, he does not know the "loudspeaker direction" and he cannot perform the additional modulation step described above. However, the home listener, who plays back the recorded signal or receives the broadcast signal, knows the loudspeaker direction and can therefore adjust his direction characteristic forming unit accordingly.

The apparatus and methods described above are suitable for processing a single electronic signal so that when such electronic signal is reconverted into sound, the listener will perceive such sound as coming from a preselected direction of perception. In certain instances, it is desirable to simultaneously process a plurality of electronic signals, so that when such electronic signals are reproduced into sound, the listener will perceive the sounds corresponding to each such electronic signal as coming from a different preselected direction of perception. For example, such multiple signal processing can be utilized to advantage to process the electronic signals produced by a plurality of microphones utilized to simultaneously pick up different portions of the sound in a concert hall.

Figure 2:
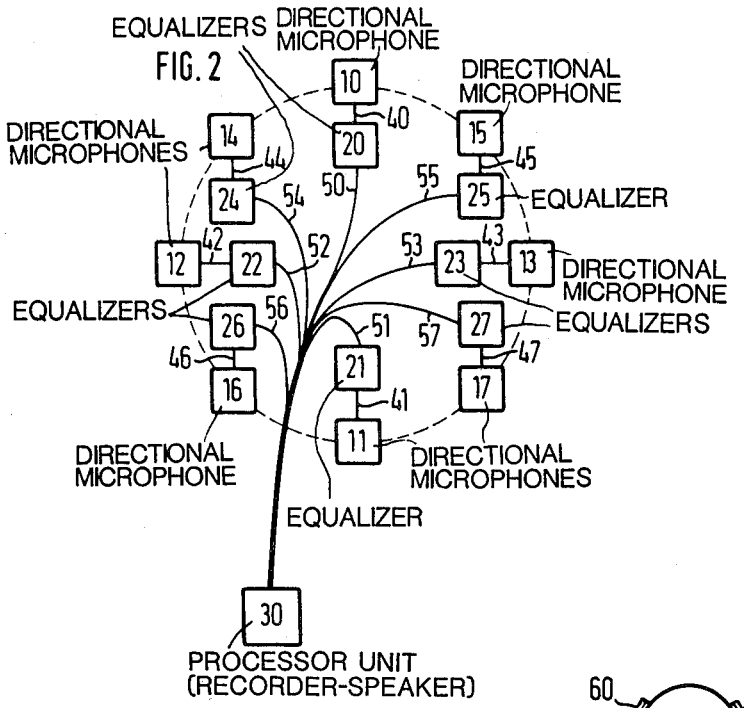

One form of such a multiple microphone arrangement, together with the direction characteristic forming units or equalizers and the processing unit to be utilized therewith is depicted in FIG. 2. This embodiment comprises eight directional microphones 10–17 located on a circle, i.e. mounted on the surface of an imaginary sphere. Assuming this figure to schematically show a top view of the arrangement, the microphones are trimmed so that microphone 10 is predominantly responsive to sound from a reception direction centre-forward of the apparatus. Microphone 11 is predominantly responsive to sound from a reception direction centre-rear of the apparatus, microphones 12 and 13 are predominantly responsive to sound from directions centre-left and centre-right, respectively, and microphones 14–17 are predominantly responsive to sound from directions forward-left, forward-right, rear-left and rear-right respectively. The reception direction of each microphone corresponds to its physical location in the microphone array.

Microphone 10 is connected through line 40 to the direction characteristic forming unit 20. This unit 20 modulates the signal received by microphone 10 with a preselected direction-representing frequency spectrum.

In the apparatus shown in FIG. 2 the sound received by the microphone 10 trimmed to collect sound from centre-forward directions is preferably modulated in unit 20 with a modulating signal or characteristic representing the "centre-forward" direction. The modulated signal is subsequently applied through line 50 to the processor unit 30, which may be a recorder or loudspeaker. Where the unit is a loudspeaker, same is disposed at any preselected direction Q from listener L.

Similarly, sound received by microphones 11–17 is applied through lines 41–47 respectively to the direction characteristic forming elements 21–27. For example, these elements are adjusted so that the signal applied by microphone 11 to element 21 through line 41 is modulated in this element with a characteristic representing the "centre-rear" direction, while elements 22–27 provide characteristics representing the centre-left, centre-right, forward-left, forward-right, rear-left and rear-right directions respectively. Thus, the signal from each microphone is modulated with a modulating signal representative of a preselected direction of perception corresponding to the reception direction of such microphone. The thus-modulated signals are applied through lines 51–57 respectively to the processor unit 30. This unit 30 serves for further processing the signals, such as for mixing, recording, re-transmission etc. Of course, if the electronic signals will be reproduced into a sound by loudspeakers, appropriate additional modulating signals can be applied to such signals to compensate for the loudspeaker direction effect as described above with reference to FIGS. 10 through 13.

Figure 3:
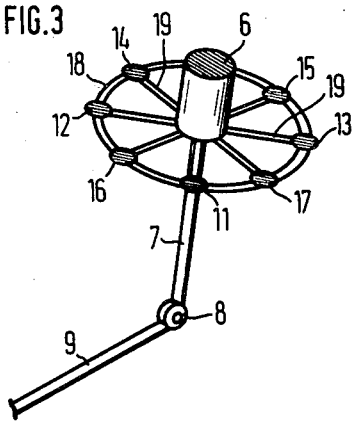
FIG. 3 shows a microphone system suitable for use in a method according to the invention.

FIG. 3 shows a microphone system suitable for use in the method according to the invention. A microphone 6, which may be an upwardly-pointing directional microphone or an omnidirectional microphone is mounted on an arm 7 pivotally connected (8) to the standard 9. A ring 18 is mounted concentrically with microphone 6 and is connected through connecting bars 19 to the bottom section of microphone 6 or the arm 7. Eight microphones, for example the directional microphones 10–17 shown in FIG. 2, are mounted on the right 18. FIG. 3 does not show the microphone 10 as this microphone is concealed by microphone 6. The lines through which the signals received by microphone 6 and microphones 10–17 are applied to the other components of the arrangement not shown in this figure as they may appropriately extend through the interior of the hollow members 18, 19 and 7. These lines apply the respective signals to a plurality of direction characteristic forming units in the manner described with reference to FIG. 2. The sound received by microphone 6 may either be modulated with a modulating signal that is representative of the direction "from above" or be left unmodulated, depending on whether the microphone 6 is on upwardly pointing directional microphone or an omnidirectional microphone.

Figure 4:
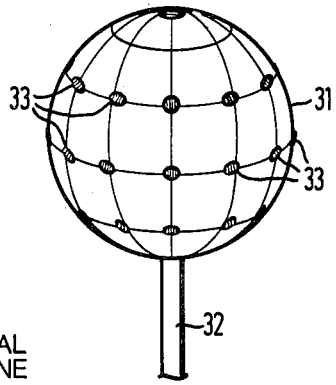
FIG. 4 shows another microphone system suitable for use in a method according to the invention.

Another microphone system suitable for use in the method according to the invention is shown in FIG. 4. This system comprises a spherical body 31 placed on a standard 32. A large number of directional microphones 33 is mounted on the surface of the spherical body 31. Signals received by these microphones 33 are applied through, for example, lines extending through the interior of body 31 and standard 32 to direction characteristic forming elements for performing the modulations described above. Instead of a large number of microphones 33, the spherical body may be provided with terminal plugs for such microphones or for supply lines for sound signals. As circumstances require, microphones may be connected to all or a number of these plugs, or sound signals recorded elsewhere may be applied thereto, which signals can subsequently be modulated in the direction characteristic forming unit connected to the respective plug in a manner similar to sound signals directly recorded by means of a microphone.

Figure 5:
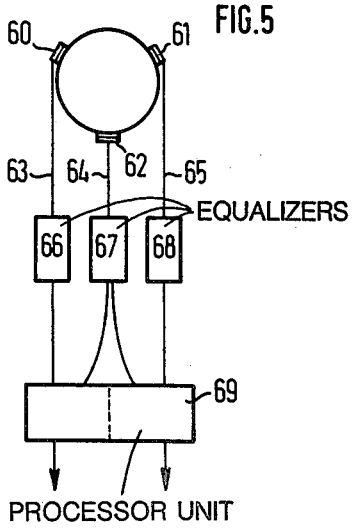
FIG. 5 schematically shows an embodiment of an apparatus for applying a method according to the invention.

FIG. 5 schematically shows the manner of operation of the apparatus for recording sound to be eventually reproduced through a conventional stereo set. The apparatus comprises three directional microphones 60, 61 and 62 located on a circle and arranged from receiving sound from the directions forward-left, forward-right and centre-rear respectively. The received sound signals are applied through lines 63, 65 and 64 respectively to direction characteristic forming elements 66, 68 and 67 respectively, in which they are modulated in the manner described above. Subsequently, the signal modulated with, for example, "centre-rear" in the element 67 is coupled with the signal modulated with "forward-left" in the element 66 and is finally applied through the processor unit 69 to the left-hand channel of a reproducing device. The signal modulated with "centre-rear" is coupled, moreover, with the signal modulated with "forward-right" in element 68 and is finally applied through unit 69 to the right-hand channel of a reproducing device.

As set forth above, it is important, in practicing the present invention to know the variation in auditory response of the normal human auditory system for sound impinging on the listener in various directions. This data is utilized in setting the direction characteristic forming unit or units to produce the modulating signal or direction characteristic representative of a preselected direction of perception, and this data is also utilized in setting the direction characteristic forming unit or units to produce the additional modulation signal which is the inverse of the direction characteristic of a loudspeaker direction. As set forth above, the data depicted in FIG. 6 represents previously known data with regard to such response. However, such known curves are not available for every possible direction. As will be appreciated, there are an infinite number of directions from which sound may impinge upon a listener. Also, although the data represented by the curves depicted in FIG. 6 is accurate enough for use in practicing the present invention, even more accurate data is desirable. The data represented in the curves of FIG. 6 were compiled by using a microphone at the entrance of a normal ear canal. Therefore, such data necessarily includes loading effects produced by the presence of the microphone itself, and such data does not include any further amplitude distortions which might be produced by phenomena intervening between the entrance of the listener's ear canal and the mind of the listener.

Figure 14:
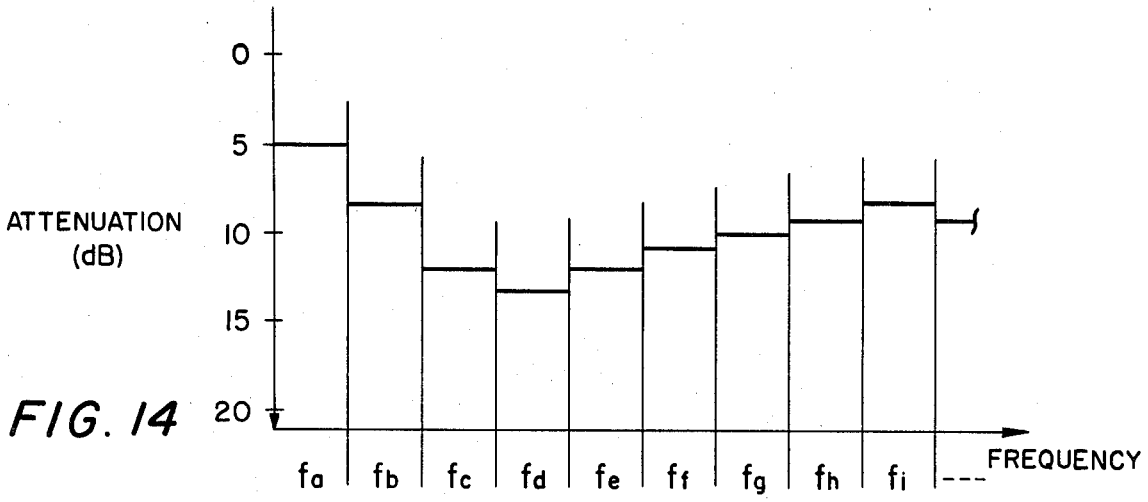
FIG. 14 is a schematic representation of equalizer control settings of the type achieved during determination of auditory system response in accordance with the auditory system response measuring method of the present invention.
Figure 15:
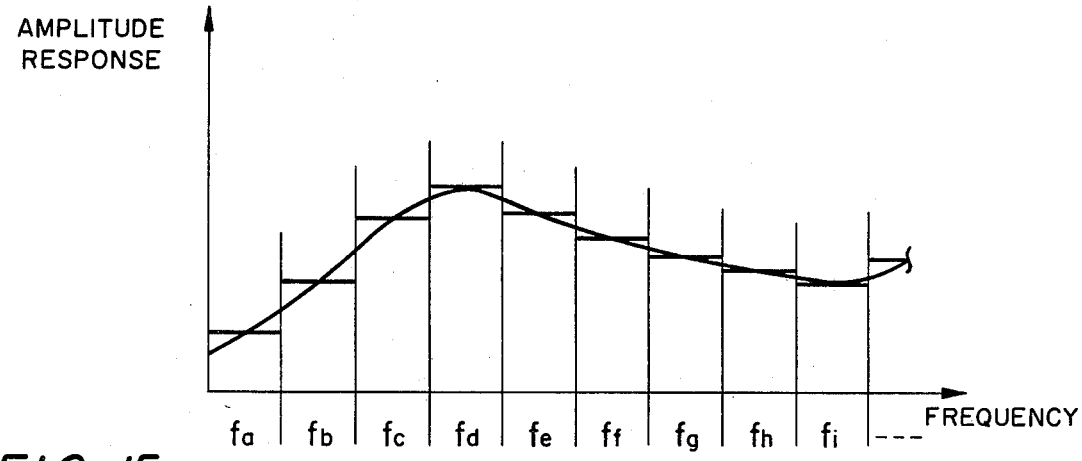
FIG. 15 is a representation of response curves determined in accordance with such method.
Figure 16:
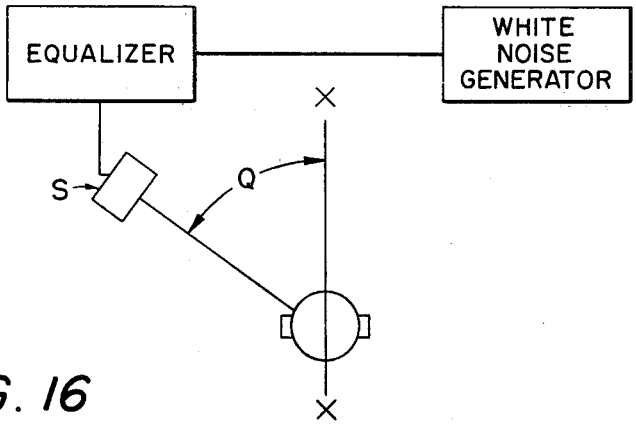
FIG. 16 is a schematic depiction of the apparatus used in such method.

Additional and better data about the auditory response of a human for sounds impinging on him from any arbitrary direction may be gathered by the response determining method depicted in FIGS. 14 through 16. As seen in FIG. 16, a "white noise generator" of any well known type is arranged to generate an audio frequency electronic signal including components of equal intensity or amplitude at every frequency within the audio frequency spectrum. This white noise generator is connected to an equalizer, which in turn is connected (through appropriate nondistorting amplifying apparatus if necessary) to a loudspeaker S. This loudspeaker is disposed at any preselected direction Q from the listener. The equalizer sould be of the type having multiple filters, each operative to attenuate portions of the electronic signal in a different frequency band, each being independently adjustable to vary the attenuation which it applies. The number of filters in the equalizer should be as great as practical, and the frequency bands over which each such filter is operative should be as narrow as possible. The frequency bands over which the various filters of the equalizer are operative should adjoin one another and should cooperatively encompass at least the major portion of the audio frequency spectrum. The "Acousta-Voicette" equalizer adverted to above can be satisfactorily used for this purpose, only one of the two 24 filter sets being employed.

The filters of the equalizer are initially set to substantially attenuate all of the components of the electronic signal, so that the listener will hear nothing. Each of the filters is then independently adjusted in the following manner: while maintaining all of the other filters of the equalizer at their substantially attenuating positions, the attenuation applied by the filter of interest is continually reduced until the listener can just hear a sound. The attenuation applied by such filter at this barely audible condition is noted, and the filter is then readjusted back to its substantially attenuating condition. The next filter is then adjusted in the same manner, and the process is repeated with each of the filters in sequence until attenuation levels have been determined for all of the filters. These attenuation levels are then plotted against the operative frequencies of the various filters, as seen for example in FIG. 14. In this arbitrary example, the plot of attenuation levels shows that the listener can hear a sound in the frequency band centered on frequency $F_c$ which is of lesser amplitude than the minimum sound that he can hear in the frequency band centered on frequency $F_b$.

The inverse of this plot of attenuation levels is then plotted, as shown in FIG. 15. This inverse plot is a bar graph representation of the auditory response curve of the listener for sound impinging upon him from direction Q. Since the listener can hear a sound of lesser amplitude in the $F_c$ centered band than in the $F_b$ centered band, the response of his auditory system is greater in the $F_c$ centered band. As also shown in FIG. 15 a smooth curve may be drawn from this bar graph representation by connecting the points at the centers of the various frequency bands.

What is claimed is:

1. A method of generating and processing electrical signals indicative of sound so that upon conversion of such signals into sounds and audition of such sounds by a normal human listener, such listener will perceive such sounds as emanating in preselected directions of perception from the listener, said method comprising the steps of:

(a) generating a plurality of signals each respectively from one of a plurality of directional microphones, each such microphone being predominantly responsive to sounds impinging on it in a unique one of a plurality of preselected directions of reception; and (b) separately modulating each said electrical signal with a unique modulating signal indicative of a different one of said preselected directions of perception so that during such modulation different amplitude adjustments will be applied to different components of said signal, such adjustments varying with frequency in a manner corresponding to the variation of amplitude response with frequency of the normal human auditory system for sounds impinging on a listener from such one direction.

2. A method as claimed in claim 1 in which said microphones are disposed in a geometrical arrangement corresponding to at least a portion of a spherical surface and the reception direction associated with each such microphone corresponds with its location in such arrangement.

3. A method as claimed in claim 1 further comprising the step of converting said electrical signals after said modulation step.

4. A method as claimed in claim 1 further comprising the step of recording said electrical signals after said modulation step.

5. Apparatus for generating and processing electrical signals representative of emanating sounds comprising:

(a) a plurality of microphones for producing said electrical signals in response to sound incident thereon, each such microphone being predominantly responsive to sounds impinging on it in a unique one of a plurality of preselected directions of reception;

(b) a plurality of modulating means, each operatively connected to a distinct one of said microphones for modulating the signal produced thereby with a modulating signal indicative of a different one of a plurality of preselected directions of perception so that during such modulation different amplitude adjustments will be applied to different components of such one signal, such adjustments varying with frequency in a manner corresponding to the variation of amplitude response with frequency of the normal human auditory system for sounds impinging on a listener from such one direction.

6. Apparatus as claimed in claim 5 in which said microphones are arranged in a spatial arrangement corresponding to at least a portion of a spherical surface, and the reception direction of each such microphone corresponds to its position in such spatial arrangement.

* * * * *